US005489027A

United States Patent [19]

Goerigk

[11] Patent Number: 5,489,027

[45] Date of Patent: Feb. 6, 1996

[54] CARTONLESS PACKAGING SYSTEM

[75] Inventor: Michael Goerigk, Hügelsheim, Germany

[73] Assignee: Allergan, Inc., Irvine, Calif.

[21] Appl. No.: 336,771

[22] Filed: Nov. 9, 1994

[51] Int. Cl.[6] ..... B65D 23/12

[52] U.S. Cl. ..... 206/570; 206/528; 215/6; 215/228; 220/212; 220/522

[58] Field of Search ..... 206/528, 531, 206/532, 535, 538, 216, 570; 215/6, 228; 220/522, 521, 212

[56] References Cited

U.S. PATENT DOCUMENTS

| | | | |
|---|---|---|---|
| 2,250,666 | 7/1941 | Godefroy | 215/46 |
| 2,276,678 | 3/1942 | Wheeler | 65/13 |
| 2,694,641 | 11/1954 | Atwood et al. | 99/78 |
| 3,064,800 | 11/1962 | Hast | 206/528 |
| 3,433,378 | 3/1969 | Ross | 215/6 |
| 3,450,306 | 6/1969 | Gill | 206/538 X |
| 3,893,280 | 7/1975 | King | 53/37 |
| 4,432,455 | 2/1984 | Savoir | 206/531 |
| 4,753,340 | 6/1988 | Blakeman et al. | 206/538 X |
| 4,776,972 | 10/1988 | Barrett | 252/90 |
| 4,856,647 | 8/1989 | Pahne | 206/5.1 |
| 5,114,011 | 5/1992 | Robbins, III | 206/499 |
| 5,127,517 | 7/1992 | Clements et al. | 205/5.1 |

*Primary Examiner*—Jacob K. Ackun
*Attorney, Agent, or Firm*—Walter A. Hackler

[57] ABSTRACT

A cartonless packaging system is provided which significantly reduces packaging waste and includes a container for containing a liquid and a nozzle disposed in one end of the container for dispensing of the liquid from the container. A cap is provided for enclosing the nozzle, and the cap is configured for being removably attached to the container. A support system is provided which encircles the nozzle for removably supporting a plurality of tablets with the support being disposed beneath the cap means when the cap means is attached to the container. In addition, instructional materials are incorporated into the cartonless packaging system, and thus no separate packaging materials are necessary for providing the separate elements to the consumer.

9 Claims, 1 Drawing Sheet

FIG. 1.
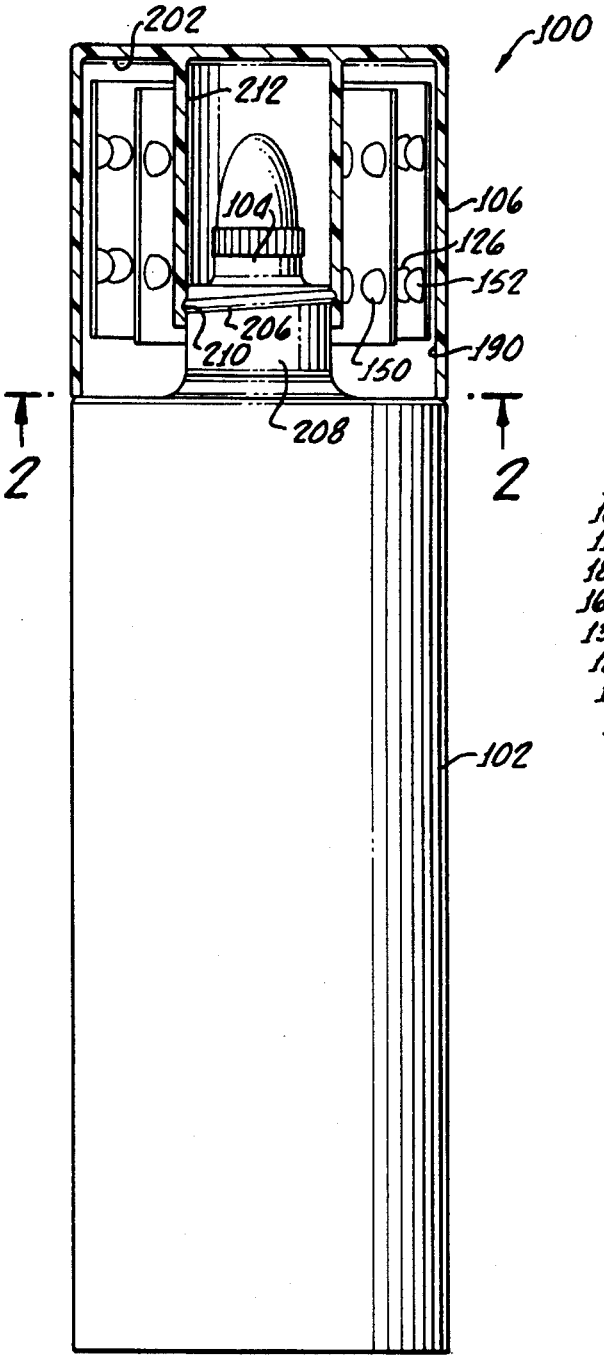
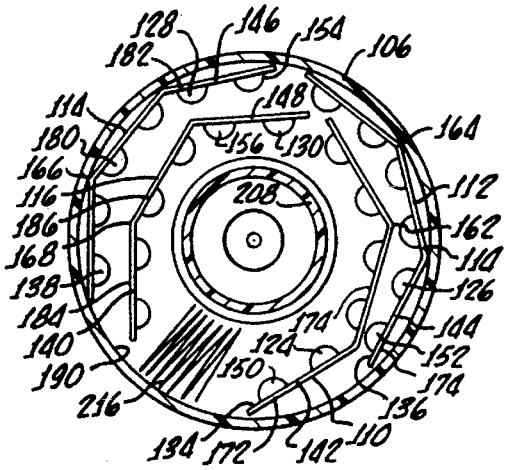
FIG. 2.

CARTONLESS PACKAGING SYSTEM

The present invention is generally directed to a cartonless packaging system and more particularly directed to a cartonless package for liquids and tablets.

Environmental concerns throughout the world have created a need for cartonless packaging and some countries, especially in Central Europe, have passed "Green" regulations regarding allowable waste in connection with the packaging of goods, particularly for consumer products.

Regulations for the reduction of packaging waste have particular significance with regard to multicomponent goods; i.e., goods in which a combination of products is sold in one carton or package which, upon opening of the package, are to be used in combination by the consumer, either serially or in parallel.

As a specific example, many ophthalmic products, particularly contact lens cleaning and sterilizing solutions are sold in multicomponent kits. More particularly in this regard, a liquid solution may be sold for the cleaning of contact lenses along with neutralizing tablets to be added to the cleaning solution following treatment of the contact lenses with the solution.

Naturally, this type of system is not sold as a single component; rather, a package is provided the consumer which includes a solution and tablets for use in conjunction with the cleaning of contact lenses. The plurality of such components inherently presents a packaging problem.

Without environmental concerns, this packaging problem is easily solved by providing separate packaging devices such as envelopes, pouches, containers and the like which are incorporated into a larger overall package for holding each of the components, or products, in a convenient manner for use by the consumer. However, this often represents a duplication in packaging materials which are ultimately disposed by the consumer and become a concern for waste management systems and procedures concomitant therewith.

Therefore, it is desirable to develop a packaging for multicomponent consumer products which eliminates or greatly reduces the intermediate packaging of items in order to reduce waste due to discarding of such packaging. The present invention fills this need by providing a cartonless packaging system for both tablets and a liquid with minimal packaging waste.

SUMMARY OF THE INVENTION

A cartonless packaging system in accordance with the present invention generally includes a container which provides means for containing a liquid and nozzle means, disposed at one end of the container, for dispensing of the liquid from the container.

A cap provides means for enclosing the nozzle means and the cap is configured for being removably attached to the container. Importantly, support means is provided which encircles the nozzle means and functions to removably the support a plurality of tablets. Because the support means is disposed beneath the cap, when the cap is attached to the container, a significant reduction in packaging materials is effected.

In accordance with the present invention, the support means may comprise at least one bendable member which includes means defining a plurality of creases in the bendable member, for enabling the bendable member to encircle the nozzle means with adjoining portions of the bendable member remaining planar.

Preferably, a plurality of tablets are disposed in each planar portion of the bendable means, and a rupturable material is provided and attached to the bendable member for providing a means for holding the tablets between the rupturable material and the bendable member. In this embodiment, an annular compartment is provided In the cap for providing means for holding the bendable member and, importantly, the bendable member has a resiliency for removably holding the bendable member within the annular compartment when the cap is detached from the container. That is, the resiliency of the bendable member causes a spreading of the bendable member as it encircles the nozzle so that it engages an inside surface of the cap to provide original contact therewith.

More particularly, the annular compartment includes the inside surface of the cap and the concentric depending member, having a smaller diameter than the diameter of the inside surface.

Attachment of the cap to the container is provided by means of a base portion of the nozzle means having a ridged portion thereon, and the depending member of the cap includes a detent for removably engaging the ridged portion. Additionally, as is the case with the first embodiment described hereinabove, means may be provided which define perforations of the bendable member between tablets for facilitating removal of the tablets, one at a time, from the bendable member.

BRIEF DESCRIPTION OF THE DRAWINGS

The advantages and features of the present invention will be better understood by the following description when considered in conjunction with the accompanying drawings in which:

FIG. 1 is a cross-sectional view of another embodiment of the present invention, showing a plurality of bendable members, each for supporting a plurality of tablets which surround a nozzle; and FIG. 2 is a cross-sectional view of the embodiment shown in FIG. 1, taken along the line 2—2 of FIG. 1, showing a plurality of bendable members encircling the nozzle.

DETAILED DESCRIPTION

Turning now to FIG. 1, there is shown a cartonless packaging system 100, in accordance with the present invention, generally including a container 102, a nozzle 104, and a cap 106, the functions of these components being hereinabove noted.

As more clearly shown in FIG. 2, the support means, in accordance with the embodiment 100, shown in FIG. 1, includes one or more bendable members 110, 112, 114, 116 which in combination encircle the nozzle 14 and provide support for a plurality of tablets 124, 126, 128. As hereinabove discussed in connection with the packaging system 10, a "blistered pack" type rupturable material 134, 136, 138, 140 may be provided attached to the members 110, 112,114,116 for holding the tablets 124, 126, 128, 130 between the material 134, 136, 138 and the members 110, 112, 114, 116. In addition, perforations 142, 144, 146, 148 may be provided between adjacent tablets 150, 152, 154, 156 to facilitate separate removal of the tablets 124–130, 150–156 from the respective members 110–116 on a one-by-one basis, as hereinabove discussed.

Each of the bendable members 110, 112, 114, 116 include creases 162, 164, 166, 168, respectively, for enabling the bendable members 110, 112, 114, 116 to encircle the nozzle 14 with the adjoining portions 172, 174 of the member 110 remaining planar. Similarly, adjoining portions 176, 178 of the member 112 remain planar; and adjoining portions 180, 182 of member 114 remain planar; and adjoining portions 184, 186 of member 116 remain planar.

Importantly, the resiliency of the bendable member, which may be any suitable cardboard or plastic material or combination thereof, is sufficient for causing the bendable members 110, 112, 114, 116 to straighten outwardly to engage inside surface 190 or an underlying member 112, 114 with sufficient resistance to enable the member 110, 112, 114, 116 to remain within a cap compartment 194 when the cap 106 is removed from the container 102. In this regard, the presence of the tablets 126, 128, protruding from the respective bendable members 112, 114, further impede slipping of the bendable members 110, 112, 114, 116 from one another when the cap 106 is removed from the container 102.

The compartment 194 is defined by the inside surface 190 of the cap 106 and a concentric member 200 depending from an underside 202 of the cap 106. The cap 106 is removably attached to the container 102 by means of a ridge 206 on a nozzle base 208 which is engaged by a detent 210 formed on an inside surface 212 of the depending member 200.

An additional instructional brochure or pamphlet 216 may be inserted into the compartment 194 in which therein by appropriate sizing of the brochure 216. Thus, no further packaging or carton is required for each of the separate items of the packaging system 100; namely, the container 102; the tablets 124, 126, 128, 130; and the instructional brochure 216. Thus, considerable savings may be obtained by the cartonless packaging system 100 as hereinabove described.

Although there has been hereinabove described a specific arrangement of a cartonless packaging system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A cartonless packaging system comprising:

squeezable container means for containing a liquid, said container means being circular in cross-section and having a top and a bottom end;

nozzle means, disposed in the container top end, for dispensing of the liquid from the container upon squeezing of the container;

cap means for enclosing said nozzle means, said cap means having an outside diameter equal to an outside diameter of the container means;

support means, including a plurality of bendable members encircling said nozzle means, for removably supporting a plurality of tablets, each bendable member comprising means, defining a plurality of creases therein, between tablets, for enabling the bendable members to encircle said nozzle means with adjoining portions of each bendable member remaining planar, a plurality of tablets are disposed on each planar portion, said support means comprising a plurality of rupturable means, one attached to each bendable member, for holding the tablets between each rupturable means and an associated bendable member;

means, defining an annular compartment within said cap means, for holding the plurality of bendable members, said last-mentioned means comprising an inside surface of said cap means and a concentric depending member having a smaller diameter than a diameter of said inside surface; and means, defining a resiliency of the bendable members, for removably holding the bendable members within the annular compartment when the cap means is detached from the container means.

2. A cartonless packaging system comprising:

container means for containing a liquid;

nozzle means, disposed in one end of said container means, for dispensing of the liquid from the container;

cap means for enclosing said nozzle means, said cap means being configured for being removably attached to said container means; and support means, comprising at least one bendable member, encircling said nozzle means, for removably supporting a plurality of tablets, said support means being disposed within said cap means when said cap means is attached to said container means means defining a resiliency of the at least one bendable member, for removably holding the at least one bendable member within the cap means when the cap means is detached from the container means.

3. The cartonless packaging system according to claim 2 wherein the bendable member comprises means, defining a plurality of creases therein, between selected tablets, for enabling the bendable member to encircle said nozzle means with adjoining portions of the bendable member remaining planar.

4. The cartonless packaging system according to claim 3 wherein a plurality of tablets is disposed in each planar portion of the bendable means.

5. The cartonless packaging system according to claim 4 further comprising rupturable means, attached to the bendable member, for holding the tablets between the rupturable means and the bendable member.

6. The cartonless packaging system according to claim 5 wherein said cap means comprises means defining an annular compartment for holding the bendable member and the bendable member has means, defining a resiliency thereof, for removably holding the bendable member within the annular compartment when the cap means is detached from the container means.

7. The cartonless packaging system according to claim 6 wherein the means defining an annular compartment comprises an inside surface of said cap means and a concentric depending member having a smaller diameter than a diameter of said inside surface.

8. The cartonless packaging system according to claim 7 Wherein said nozzle means comprises a base portion with a ridge portion therein and said depending member comprises means defining a detent therein, for removably engaging the ridge portion.

9. The cartonless packaging system according to claim 8 further comprising means, defining perforation in the bendable member between tablets, for facilitating removal of the tablets, one at a time, from the bendable member.

* * * * *